US007877046B2

(12) United States Patent
Nelson et al.

(10) Patent No.: US 7,877,046 B2
(45) Date of Patent: Jan. 25, 2011

(54) HARD IMAGING DEVICES AND HARD IMAGING METHODS

(75) Inventors: Eric G. Nelson, San Diego, CA (US); Michael H. Lee, San Jose, CA (US); Quang P. Lam, Hayward, CA (US); Noa Falk, Petach Tikwa (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 314 days.

(21) Appl. No.: 11/999,804

(22) Filed: Dec. 7, 2007

(65) Prior Publication Data

US 2009/0148190 A1 Jun. 11, 2009

(51) Int. Cl.
*G03G 15/10* (2006.01)

(52) U.S. Cl. ..... 399/249

(58) Field of Classification Search ..... 399/249, 399/264, 239, 53, 57

See application file for complete search history.

(56) References Cited

U.S. PATENT DOCUMENTS 5,265,535 A * 11/1993 Isowa et al.
5,432,591 A 7/1995 Geleynse
5,758,236 A 5/1998 Teschendorf et al.
5,805,963 A 9/1998 Teschendorf et al.
5,981,133 A * 11/1999 Miyamoto et al.
6,198,894 B1 3/2001 Park
6,208,822 B1 * 3/2001 Kitoba et al. ..... 399/57
6,345,166 B1 * 2/2002 Sakaizawa et al.
6,356,731 B1 * 3/2002 Shinjo
6,496,676 B1 * 12/2002 Caruthers et al.
6,829,464 B2 * 12/2004 Haraguchi et al.
7,058,341 B2 * 6/2006 Kellie ..... 399/239
2006/0222390 A1 * 10/2006 Sasaki et al.
2008/0101806 A1 * 5/2008 Tabata et al.

FOREIGN PATENT DOCUMENTS

JP 2000246877 A * 9/2000
JP 2001242717 A * 9/2001
JP 2002148944 A * 5/2002
WO WO93/01531 1/1993
WO WO94/16364 7/1994

* cited by examiner

*Primary Examiner*—Susan S Lee

(57) ABSTRACT

Hard imaging devices and hard imaging methods are described. According to one embodiment, a hard imaging device includes a photoconductor, a developer member configured to move to provide a marking agent upon the photoconductor to develop a latent image upon the photoconductor, and a squeegee member configured to form a nip with the developer member and to move to provide the marking agent upon the developer member, wherein the squeegee member is configured to move at a speed slower than a speed of the developer member during the provision of the marking agent upon the developer member using a squeegee member.

30 Claims, 5 Drawing Sheets

HARD IMAGING DEVICES AND HARD IMAGING METHODS

FIELD OF THE DISCLOSURE

Aspects of the disclosure relate to hard imaging methods and hard imaging devices.

BACKGROUND OF THE DISCLOSURE

Imaging devices capable of printing images upon paper and other media are ubiquitous and used in many applications including monochrome and color applications. For example, laser printers, ink jet printers, and digital printing presses are but a few examples of imaging devices in wide use today for monochrome or color imaging.

Electrophotographic imaging processes utilize a photoconductor which may be electrically charged and then selectively discharged to form latent images. The latent images may be developed and transferred to output media to form hard images upon the media. Electrophotographic imaging processes may be implemented in laser printer configurations and digital presses in illustrative examples.

Some imaging devices use a marking agent to develop the latent images. Ingredients of the marking agents may be varied according to customer demands, for example, to provide improved customer attributes, such as durability and consistency. However, varying the ingredients of the marking agent may result in unacceptable imaging operations in the imaging devices using the marking agent. For example, unintended non-uniformities in the printed output (e.g., flow streaks) may result during imaging operations using some types of marking agents. One example of flow streaks include image density variations with a given frequency (e.g., millimeters) along the page width and individual features running tens of millimeters down the page. At least some embodiments of the disclosure are directed to hard imaging devices and methods which permit use of a wide range of different marking agents while providing acceptable print quality output. Additional embodiments are described in the following disclosure.

SUMMARY

According to some aspects of the disclosure, hard imaging methods and hard imaging devices are described.

According to one embodiment, a hard imaging device comprises a photoconductor, a developer member configured to move to provide a marking agent upon the photoconductor to develop a latent image upon the photoconductor, and a squeegee member configured to form a nip with the developer member and to move to provide the marking agent upon the developer member, wherein the squeegee member is configured to move at a speed slower than a speed of the developer member during the provision of the marking agent upon the developer member using the squeegee member.

According to another embodiment, a hard imaging method comprises providing marking agent through a nip of a squeegee member and a developer member to provide the marking agent upon the developer member. The method further includes, after the providing, transferring the marking agent from the developer member to a photoconductor to develop latent images formed upon the photoconductor, and during the providing, moving a portion of the squeegee member which contacts the marking agent at a speed which is slower than a speed of a portion of the developer member which contacts the marking agent.

Other embodiments are described as is apparent from the following disclosure.

DESCRIPTION OF THE DRAWINGS

FIG. 5 is a top view showing operations of an example of a clutch in the gearing arrangement of FIG. 4 according to one embodiment.

DETAILED DESCRIPTION

According to some embodiments of the disclosure, hard imaging devices and hard imaging methods utilize a marking agent to develop and form hard images upon media. Example marking agents which may be used include dry marking agents (e.g., toner) and liquid marking agents. One example of a liquid marking agent comprises ink particles suspended in a liquid carrier, such as oil. One suitable liquid marking agent is Electroink® available from the Hewlett-Packard Company. During example development operations using a liquid marking agent, the ink particle concentration of the liquid marking agent is increased by several times in a development assembly and the agent is applied to a photoconductor to develop latent images formed thereon and at least a substantial portion of the remaining liquid carrier evaporates prior to transfer of the ink particles to media. More recently, there have been applications where it is desired to change ingredients of the marking agents, for example for improved durability and/or consistency of printed output. As mentioned above, the altering of the marking agent compositions has resulted in unacceptable printed output in some conventional arrangements. The present disclosure provides examples of methods and apparatus for providing printed output of acceptable quality with usage of marking agents having different compositions.

Figure 1:
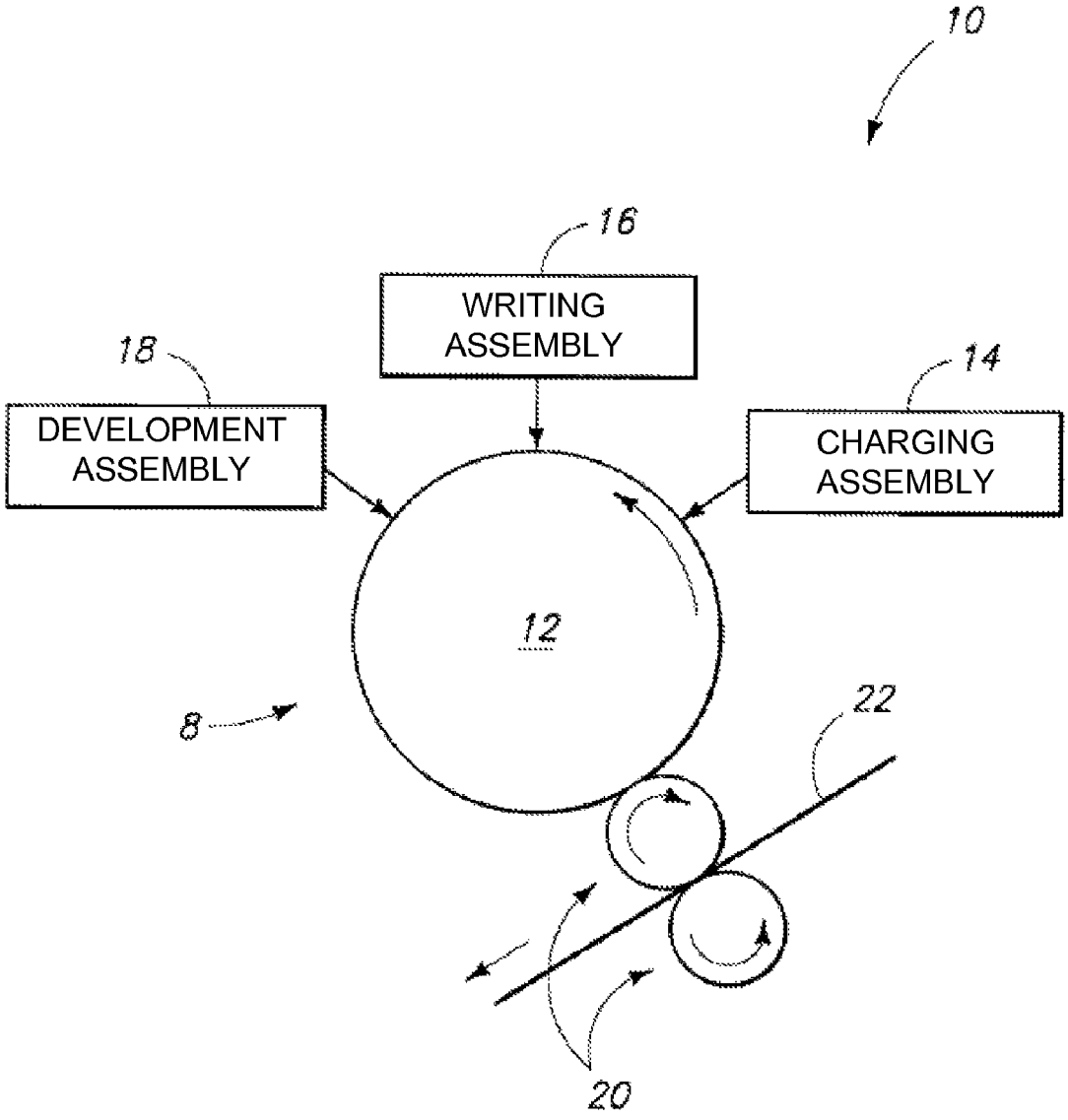
FIG. 1 is an illustrative representation of a hard imaging device according to one embodiment.

Referring to FIG. 1, an example of an image engine 8 of a hard image device 10 is shown according to one illustrative embodiment. The depicted arrangement of the hard imaging device 10 is configured to implement electrophotographic imaging wherein latent images are developed to form developed images which are subsequently transferred to output media to form hard images. Examples of hard imaging devices 10 include digital presses (e.g., Indigo® presses available from the Hewlett-Packard Company) which utilize a liquid marking agent although other configurations may be used.

The image engine 8 of hard imaging device 10 depicted in FIG. 1 includes a photoconductor 12, a charging assembly 14, a writing assembly 16, a development assembly 18, and a transfer assembly 20. Hard imaging device 10 is configured to form hard images upon media 22, such as paper or other suitable imaging substrates. Other hard imaging devices 10 may include more, less or alternative components or other arrangements in other embodiments.

In one operational embodiment, charging assembly 14 is configured to deposit a blanket electrical charge upon substantially an entirety of an outer surface of photoconductor 12. Writing assembly 16 is configured to discharge selected portions of the outer surface of the photoconductor 12 to form latent images. Development assembly 18 is configured to provide a marking agent to the outer surface of photoconductor 12 to develop the latent images formed thereon. In one embodiment, the marking agent is a liquid marking agent. Ink particles of the liquid marking agent may be electrically charged to the same electrical polarity as the blanket charge provided to the outer surface of the photoconductor 12 and attracted to the discharged portions of the outer surface of the photoconductor 12 corresponding to the latent images to develop the latent images. The developed images are transferred by transfer assembly 20 to media 22.

Figure 2:
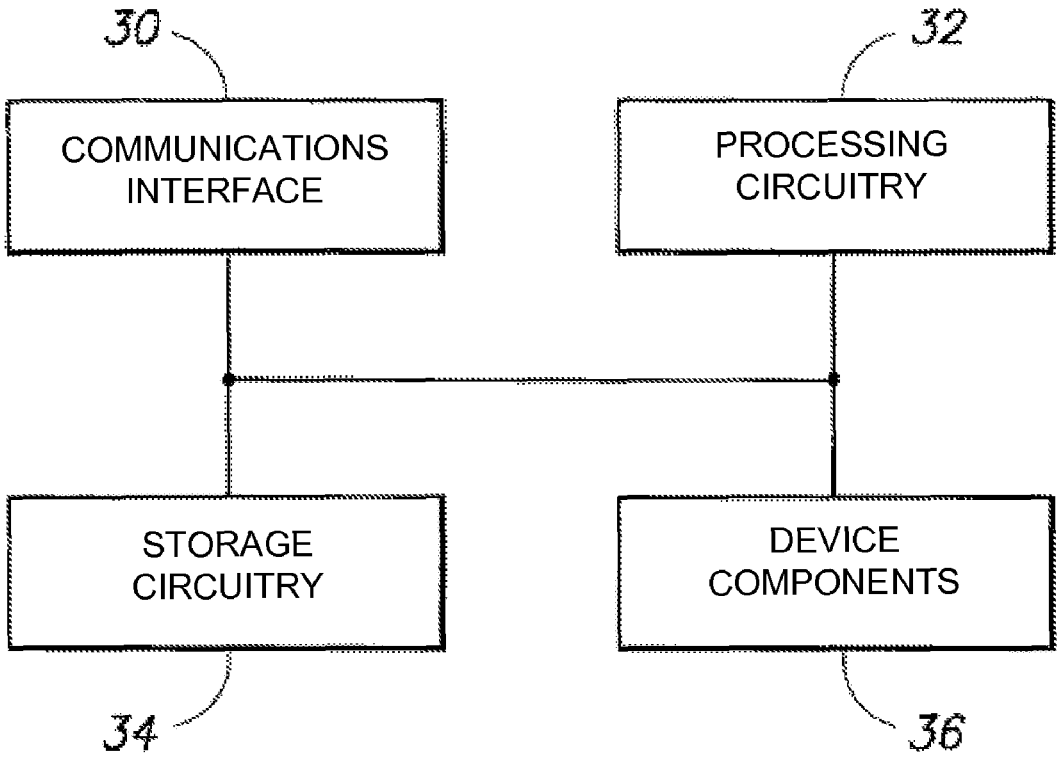
FIG. 2 is a functional block diagram of circuitry of the hard imaging device according to one embodiment.

Referring to FIG. 2, an example of electrical components of hard imaging device 10 is illustrated according to one embodiment. The electrical components include a communications interface 30, processing circuitry 32, storage circuitry 34 and device components 36 in one embodiment of hard imaging device 10. More, less or alternative components are provided in other embodiments of hard imaging device 10.

Communications interface 30 is arranged to implement communications of hard imaging device 10 with respect to external devices (not shown). For example, communications interface 30 may be arranged to communicate information bi-directionally with respect to device 10. Communications interface 12 may be implemented as a network interface card (NIC), serial or parallel connection, USB port, Firewire interface, flash memory interface, floppy disk drive, or any other suitable arrangement for communicating with respect to device 10. In one example, image data of hard images to be formed may be received by communications interface 30.

In one embodiment, processing circuitry 32 is arranged to process data, control data access and storage, issue commands, and control imaging operations of device 10. Processing circuitry 32 may comprise circuitry configured to implement desired programming provided by appropriate media in at least one embodiment. For example, the processing circuitry 32 may be implemented as one or more of a processor and/or other structure configured to execute executable instructions including, for example, software and/or firmware instructions, and/or hardware circuitry. Exemplary embodiments of processing circuitry 32 include hardware logic, PGA, FPGA, ASIC, state machines, and/or other structures alone or in combination with a processor. These examples of processing circuitry 32 are for illustration and other configurations are possible.

Processing circuitry 32 is configured to control imaging operations of device 10, such as the formation and development of latent images upon photoconductor 12. Processing circuitry 32 may also operate as a control system in some embodiments described below to monitor levels of marking agent within development assembly 18 and to control flow of marking agent from development assembly 18 responsive to the monitoring of the level of the marking agent in the development assembly 18. As described below, the monitoring and flow control is implemented in one embodiment to reduce the presence of bubbles in the liquid marking agent.

The storage circuitry 34 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 34 described above and/or communicated via a network or other transmission media and configured to control appropriate processing circuitry. For example, programming may be provided via appropriate media including, for example, embodied within articles of manufacture. In another example, programming may be embodied within a data signal (e.g., modulated carrier wave, data packets, digital representations, etc.) communicated via an appropriate transmission medium, such as a communication network (e.g., the Internet and/or a private network), wired electrical connection, optical connection and/or electromagnetic energy, for example, via a communications interface, or provided using other appropriate communication structure. Exemplary programming including processor-usable code may be communicated as a data signal embodied in a carrier wave in but one example.

Device components 36 include additional electrical components of the hard imaging device 10. For example, device components 36 may include sensors, pumps, motors, a user interface, variable valves, and other additional electrical components which may be controlled or monitored by processing circuitry 32.

Figure 3:
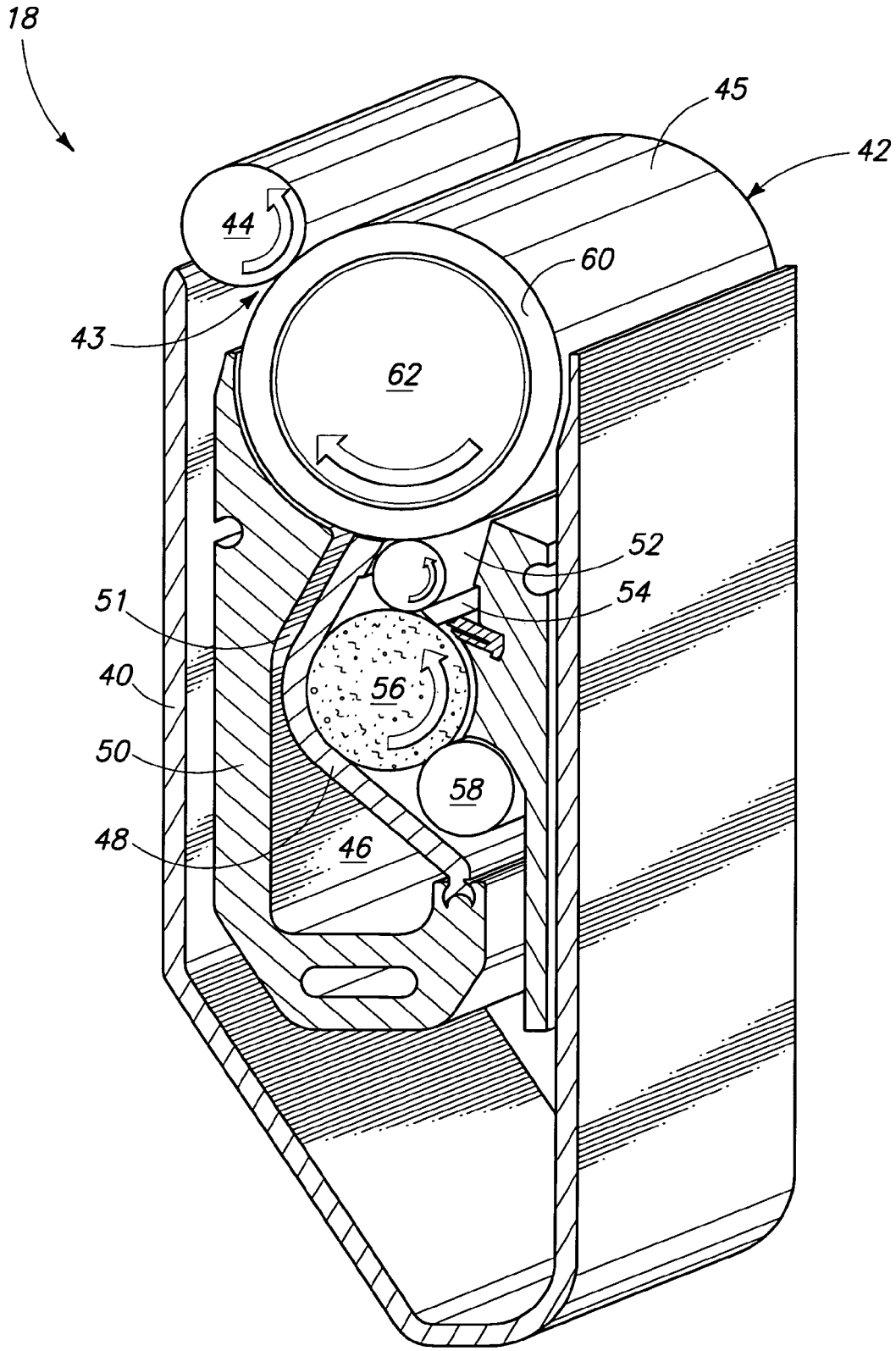
FIG. 3 is an illustrative representation of a development assembly of the hard imaging device according to one embodiment.

Referring to FIG. 3, details of one embodiment of development assembly 18 of image engine 8 are shown. A single arrangement of development assembly 18 of FIG. 3 may be used for monochrome hard imaging devices 10. In addition, a plurality of the arrangements of assemblies 18 of FIG. 3 may be used for different colors of color hard imaging devices 10. In one example (e.g., including a plurality of development assemblies 18 for respective separations), the assemblies 18 may be spaced from photoconductor 12 when the assemblies are not developing latent images and may be individually moved to a development position such that the development assembly 18 provides the appropriate color marking agent to the photoconductor 12 at an appropriate moment in time to develop latent images on the photoconductor 12.

In one embodiment, the example development assembly 18 includes a housing 40 which partially houses a developer member 42 and a squeegee member 44 (e.g., members 42, 44 are rollers in the depicted example embodiment). Although not shown in FIG. 3, photoconductor 12 is provided adjacent to developer member 42 and a surface 45 of developer member 42 is configured to move (e.g., rotate) to provide a layer of marking agent to a rotating outer surface of the photoconductor 12 to develop latent images formed upon the outer surface of the photoconductor 12. In one embodiment, developer member 42 includes a polyurethane outer layer 60 provided about a metal core 62.

During imaging operations, the marking agent may be introduced from a reservoir (not shown) into development assembly 18 at an internal chamber 46 defined by a back electrode 48 and a main electrode 50. The received marking agent flows upwards through a chamber 51 to the surface 45 of developer member 42 where the developer member 42 rotating in a clockwise direction urges the marking agent towards a nip 43 defined by members 42, 44 (e.g., members 42, 44 contact one another at nip 43 in one example embodiment). Squeegee member 44 is configured to move (e.g., rotate) to provide a substantially uniform layer of marking agent upon surface 45 of developer member 42. In one embodiment, squeegee member 44 removes excess marking agent and packs down a layer of ink particles of the marking agent upon surface 45 in arrangements which utilize a liquid ink marking agent. The packed down concentrated layer of ink particles is utilized to develop latent images upon the photoconductor 12 in the described example.

Following development, cleaner roller 52 operates to remove undeveloped ink particles from surface 45 of developer member 42. A wiper 54 operates to remove ink particles from cleaner roller 52 and a sponge roller 56 operates to mix the removed ink particles with other liquid marking agent present in the housing 40 of development assembly 18. A squeezer roller 58 operates to wring out the sponge roller 56 in the illustrated embodiment.

As mentioned above, the ink particles may be electrically charged (e.g., negatively to −300 μC/g) in one embodiment to facilitate imaging operations including development of latent images upon photoconductor 12. In addition, the charging of the ink particles may assist with the provision of the marking agent upon developer member 42. In one example, squeegee roller 44 may be biased at a negative voltage (e.g., −825 V) to urge negatively charged ink particles to surface 45. Additional components of the development assembly 18 may also be electrically biased in one embodiment to facilitate imaging operations. For example, back electrode 48 and main electrode 50 may be both biased at −1200 V. Developer member 42 may be biased at −450 V and cleaner roller 52 and wiper 54 may be both biased at −225 V in one embodiment.

As mentioned above, marking agents having different compositions may be used by different customers and/or different printing applications. Some marking agent compositions may be more susceptible to result in non-uniformities (e.g., streaking) in printed output compared with the use of other marking agents. At least some embodiments of the disclosure are configured to provide hard image output upon media having acceptable print quality in combination with the use of different marking agents having different ingredients or compositions to form the hard images.

In some conventional imaging device configurations, the surface of a squeegee (e.g., corresponding to squeegee member 44 of the present disclosure) rotates at the same speed as the surface of a developer (e.g., corresponding to developer member 42 of the present disclosure) to avoid damage to the developer and/or squeegee. However, the above-described non-uniformities may occur in printed output if the speeds of the squeegee and developer are substantially the same during imaging operations.

According to one embodiment of the disclosure, a rotational surface speed of the squeegee member 44 may be varied during imaging operations and may differ from a rotational surface speed of developer member 42 to provide imaging operations of acceptable print quality when used with marking agents of different or varied ingredients or compositions. In one embodiment, and as discussed below in further detail below, the squeegee member 44 moves at a plurality of different speeds corresponding to the presence and absence of the marking agent at the nip 43. For example, squeegee member 44 moves at a speed slower than a speed of the developer member 42 during the presence of the liquid marking agent at the nip 43 and moves at the same speed as the developer member 42 during the absence of the marking agent at the nip 43 in one embodiment. As discussed in further detail below, a portion of the squeegee member 44 which contacts the marking agent (e.g., the outer surface of the member 44) moves at a speed slower than a portion of developer member 42 which contacts the marking agent (e.g., surface 45) in one embodiment.

For example, in one embodiment, the surface speed of the squeegee member 44 may be less than the surface speed of the developer member 42 during provision of a layer of liquid marking agent upon the developer member 42 and which results in a slight buildup of excess marking agent at the entrance to nip 43. In one embodiment, the surface speed of the squeegee member 44 is configured to rotate at approximately 25% of the surface speed of the developer member 42. The rotational speed of the surface of the squeegee member 44 may be configured to rotate at other speeds in other embodiments (e.g., a range of 10-80% of the rotational speed of the surface of the developer member). The buildup at nip 43 protects the layer of marking agent formed upon the surface 45 of the developer member 42 from damage as well as filling in existing flow streaks in this layer of the marking agent. The above-described example embodiment provides acceptable print quality output with greatly reduced or non-existent flow streaks in the printed output with the usage of different marking agents having different compositions compared with the above-described conventional arrangements.

As discussed above, developer member 42 includes an outer polyurethane layer. 60 in one embodiment. Frictional forces between the squeegee member 44 and developer member 42 moving at different rotational surface speeds during an absence of marking agent at nip 43 may damage the surface 45 of developer member 42 and render the surface 45 unsuitable for imaging operations. Accordingly, in one embodiment, the development assembly 18 provides rotation of the surfaces of developer member 42 and squeegee member 44 at different speeds when the marking agent is present at nip 43 (i.e., when the marking agent provides reduced friction between developer and squeegee members 42, 44) to provide acceptable print quality and at the same speeds in the absence of the marking agent at nip 43 to avoid damage to members 42, 44. For example, dry cycling operations may be performed (where no marking agent is present at nip 43) to periodically clean and remove excess ink from components of the image engine.

Figure 4:
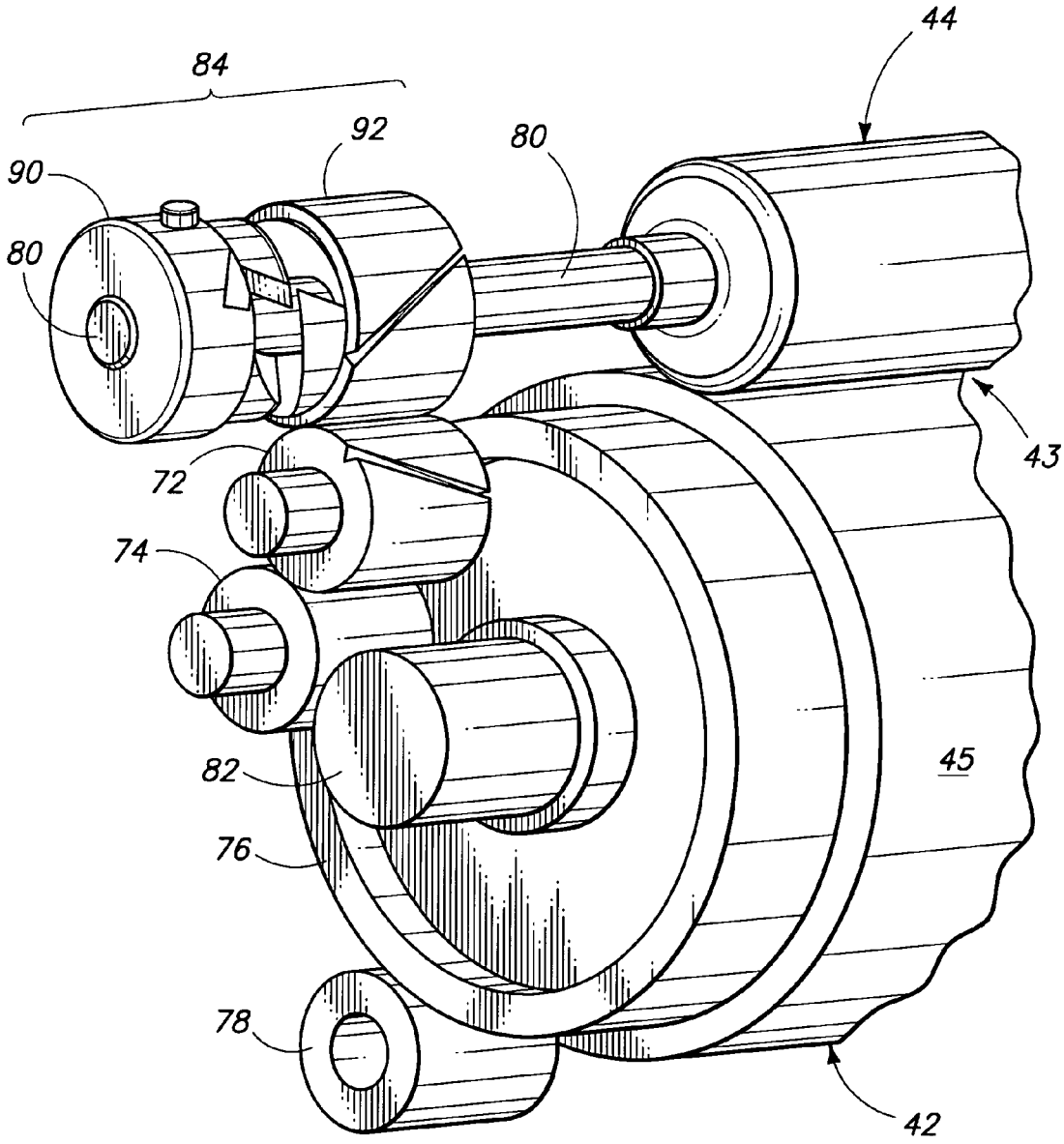
FIG. 4 is an isometric view of an example of gearing and other components of the development assembly according to one embodiment.
Figure 11:
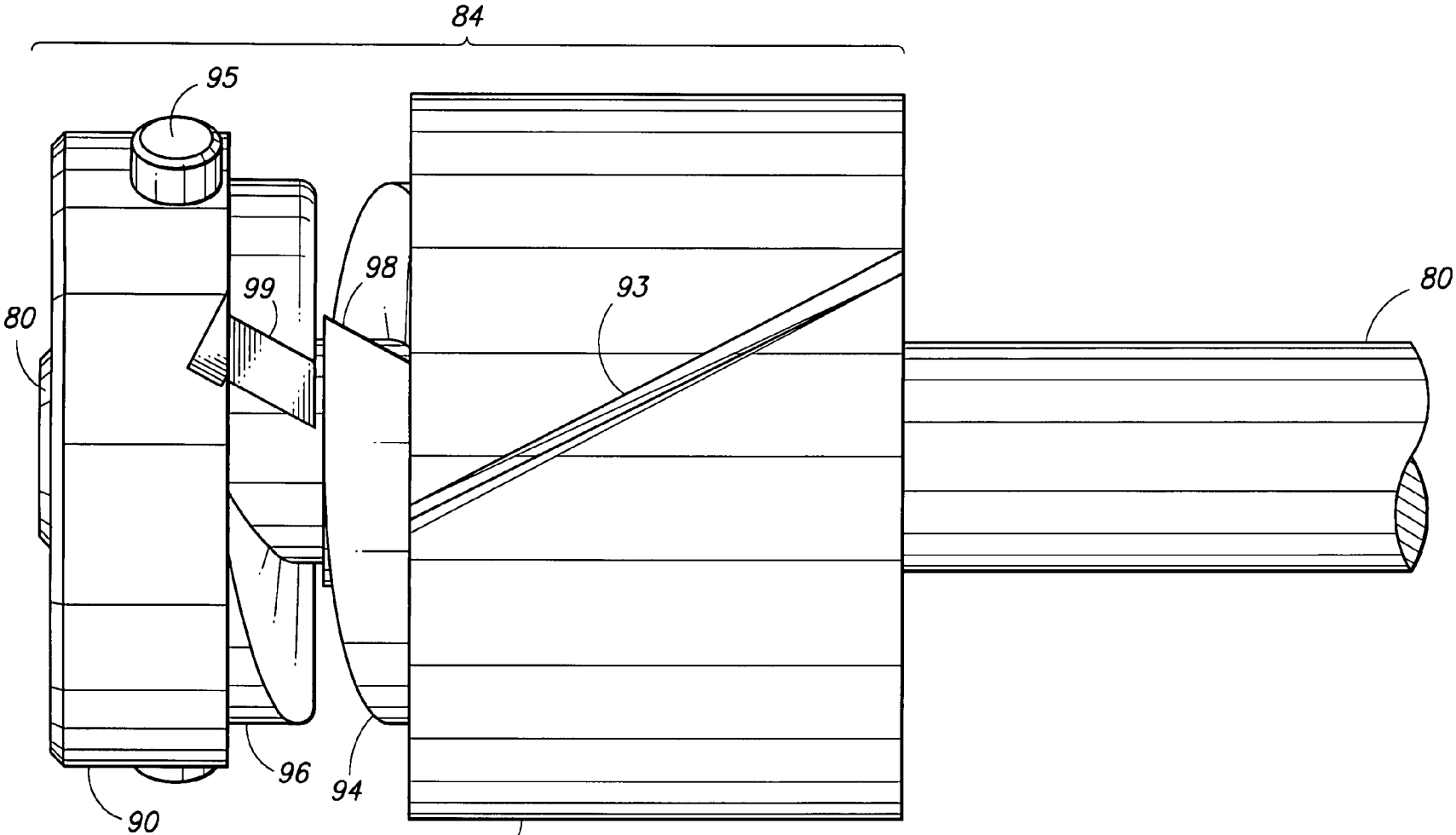

Referring to FIG. 4, an illustrative embodiment for implementing different rotational speeds of the squeegee member 44 with respect to the developer member 42 is described. Other embodiments are possible.

FIG. 4 depicts the developer member 42 and squeegee member 44 and additional components to provide different rotational speeds therebetween. For example, in the depicted embodiment, a clutch 84 and gearing between members 42, 44 may be configured to provide desired rotational speeds of members 42, 44. A first developer gear 82 is configured to rotate with and at the same rotational speed as developer member 42. Developer gear 82 is additionally configured to rotate with idler gears 72, 74 which provide the desired speed of rotation of the squeegee member 42 relative to the developer member 44 via clutch 84 described below and when marking agent is present at nip 43. In one embodiment, developer gear 82 is driven and is configured to drive rotation of idler gears 72, 74. In the illustrated embodiment, a cleaner gear 78 is also driven by a second developer gear 76 and is configured to drive rotation of cleaner roller 52 shown in FIG. 3.

In one embodiment, clutch 84 is configured to allow squeegee member 44 to rotate at a surface speed different than the surface speed of developer member 42 during the presence of marking agent at nip 43 and to rotate at substantially the same surface speed of the developer member 42 during an absence of marking agent at nip 43. In the depicted embodiment, idler gear 72 drives squeegee gear 92 of clutch 84 during the presence of marking agent at nip 43 and clutch 84 permits squeegee member 42 to rotate at speeds greater than a speed of idler gear 72 in the absence of marking agent at nip 43. Additional details of clutch 84 including operation of a clutch mate 90 and squeegee gear 92 thereof are described below in one embodiment with respect to FIG. 5.

In the described embodiment, clutch 84 allows the squeegee member 44 to rotate faster than squeegee gear 92 but prevents member 44 from rotating slower than squeegee gear 92 when the clutch is engaged. In one embodiment, the presence of marking agent at nip 43 provides relatively low friction at nip 43 and squeegee member 44 is driven by idler gear 72 and clutch 84 to a rotational surface speed which is slower than the rotational surface speed of developer member 42. During an absence of marking agent at nip 43, the friction at nip 43 increases significantly and the clutch 84 permits the surface 45 of developer member 42 to directly drive squeegee member 44 to the speed of developer member 42 without slip and without damaging developer member 42 in one embodiment.

Referring to FIG. 5, operations of clutch 84 are described according to one possible embodiment. Clutch 84 includes a clutch mate 90 and a squeegee gear 92 in the illustrated arrangement. A pin 95 fixes rotation of clutch mate 90 to a shaft 80 which is configured to rotate with squeegee member 44 (member 44 is not shown in FIG. 5). Squeegee gear 92 is configured to freely rotate about shaft 80 while also being configured to freely move axially along shaft 80. In one embodiment, an outer surface of gear 92 has helical grooving or teeth 93 which mesh with mating helical grooving or teeth on the outer surface of idler gear 72. In one example, helical grooving or teeth 93 having an angle of approximately 30 degrees were used. However, other angles (e.g., 45 degrees) may be used in other embodiments.

In the absence of marking agent at nip 43, the relatively high friction at nip 43 causes the squeegee member 44 (and shaft 80) to rotate at an increased speed with developer member 42 (in a direction counter-clockwise when the apparatus of FIG. 5 is viewed from the left in FIG. 5). In particular, clutch 84 is configured in the described embodiment to allow clutch mate 90 to disengage from squeegee gear 92 permitting squeegee member 42 to rotate faster than the driven speed of squeegee gear 92.

In the presence of marking agent at nip 43, the friction at nip 43 drops significantly and to a degree such that squeegee member 44 is no longer driven by the driven rotation of surface 45 of developer member 42. The helical gearing between squeegee gear 92 and idler gear 72 urges the squeegee gear 92 in the left direction as shown in FIG. 5. Clutch mate 90 and squeegee gear 92 include a plurality of opposing ramps 96, 94, respectively. During the presence of marking agent at nip 43, the rotational speed of shaft 80 momentarily slows to a speed less than the driven speed of squeegee gear 92 while the helical gearing of squeegee gear 92 urges gear 92 to the left such that ramps 94, 96 operate to engage opposing surfaces 98, 99 of squeegee gear 92 and clutch mate 90, respectively, and which locks rotation of shaft 80 in the counter-clock direction (when viewed from the left of FIG. 5) with the rotation of squeegee gear 92. In the described example, the surface of squeegee member 44 rotates at approximately 25% of the speed of rotation of the surface of the developer member 42 when the clutch mate 90 and squeegee gear 92 are locked. In another embodiment, a spring (not shown) may be provided to assist with movement of squeegee gear 92 to the left to provide engagement and locking.

In one embodiment, clutch mate 90 and squeegee gear 92 remain locked during imaging until an operational mode wherein marking agent is no longer supplied to nip 43 whereupon increased friction at nip 43 causes squeegee member 44 (and shaft 80) to begin to rotate at the increased speed of the developer member 42 and the clutch mate 90 disengages from squeegee gear 92. The squeegee member 44 and shaft 80 may continue to rotate at the increased speed of the developer member 42 until marking agent is reintroduced to nip 43. In one embodiment, the rotational speed of developer member 44 remains substantially constant in the same direction (e.g., clockwise in the example of FIG. 3) while the rotational speed of the squeegee member 44 varies corresponding to the presence or absence of the marking agent at nip 43.

In at least one embodiment, friction in the absence of marking agent at nip 43 causes the surface of the squeegee member 44 to move at the speed of the surface of the developer member 44 while the presence of marking agent at nip 43 reduces the friction between members 42, 44 and permits squeegee member 44 to move at a speed independent of (e.g., slower) a speed of developer member 42.

As described above, at least some illustrative embodiments of the present disclosure provide methods and apparatus which allow use of marking agents having different ingredients or compositions corresponding to desires of different customers and/or different imaging applications while providing imaging of hard images upon media with acceptable print quality.

Aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative acts than those methods explicitly disclosed as well as apparatus which includes less, more and/or alternative structure than the explicitly disclosed structure.

The protection sought is not to be limited to the disclosed embodiments, which are given by way of example only, but instead is to be limited only by the scope of the appended claims.

What is claimed is:

1. A hard imaging device comprising:

a photoconductor;

a developer member configured to move to provide a marking agent upon the photoconductor to develop a latent image upon the photoconductor, wherein the marking agent is a liquid marking agent; and a squeegee member configured to form a nip with the developer member and to move to provide the marking agent upon the developer member, wherein the squeegee member is configured to move at a plurality of different speeds corresponding to a presence and an absence of the marking agent at the nip, and wherein the squeegee member is configured to move at the speed slower than the speed of the developer member during the presence of the marking agent at the nip and to move at the same speed as the developer member during the absence of the marking agent at the nip.

2. The device of claim 1 wherein the developer member and the squeegee member contact one another during the movement of the squeegee member at the plurality of speeds, and wherein the developer member is configured to move at a substantially constant speed during the movement of the squeegee member at the plurality of different speeds.

3. The device of claim 2 wherein the squeegee member is configured to rotate in the same direction during the movement of the squeegee member at the plurality of speeds.

4. The device of claim 1 further comprising a clutch configured to permit the squeegee member to move at the speed of the developer member during the absence of the marking agent and to control the squeegee member to move at the speed slower than the speed of the developer member during the presence of the marking agent.

5. The device of claim 1 wherein the squeegee member is configured to remove excess amounts of the marking agent during the provision of the marking agent upon the developer member.

6. The device of claim 1 wherein the liquid marking agent comprises a plurality of ink particles suspended in a liquid carrier, and wherein the ink particles are electrically charged to provide the liquid marking agent upon the developer member.

7. The device of claim 1 wherein the squeegee member is configured such that friction between the squeegee member and the developer member moves the squeegee member at the speed of the developer member during an absence of the marking agent at the nip and the squeegee member is further configured to move at the speed slower than and independent of the speed of the developer member during the presence of the marking agent at the nip.

8. A hard imaging method comprising:

using an image engine, generating a plurality of latent images corresponding to a plurality of hard images to be formed;

providing a marking agent upon a moving member of the image engine;

using a squeegee member of the image engine, removing an excess portion of the marking agent from the moving member;

using the marking agent upon the moving member, developing the latent images to form a plurality of developed images;

operating the squeegee member at a plurality of different speeds during movement of the moving member and corresponding to a presence and an absence of the marking agent at the squeegee member; and after the developing, transferring the developed images to media to form the hard images.

9. The method of claim 8 wherein the moving member is a developer member and the generating comprises generating the latent images using a photoconductor, and wherein the developing comprises transferring the marking agent from the developer member to the photoconductor to develop the latent images.

10. The method of claim 9 wherein the squeegee member forms a nip with the developer member, and wherein the operating comprises operating the squeegee member at the different speeds corresponding to respective ones of a presence and an absence of the marking agent at the nip.

11. The method of claim 10 further comprising moving the developer member at a substantially constant speed during the operating of the squeegee member at the different speeds.

12. The method of claim 9 wherein the operating comprises moving the squeegee member at a first speed corresponding to a speed of the moving member at a first moment in time, and moving the squeegee member at a second speed different than the speed of the moving member at a second moment in time.

13. The method of claim 9 wherein the operating comprises operating the squeegee member at one of the speeds which is slower than a speed of the moving member during the removing.

14. A hard imaging method comprising:

providing marking agent through a nip of a squeegee member and a developer member to provide the marking agent upon the developer member;

after the providing, transferring the marking agent from the developer member to a photoconductor to develop latent images formed upon the photoconductor; and during the providing, moving a portion of the squeegee member which contacts the marking agent at a plurality of different speeds corresponding to a presence and an absence of the marking agent at the nip, including a speed which is slower than a speed of a portion of the developer member which contacts the marking agent.

15. The method of claim 14 further comprising moving the portion of the squeegee member at the speed of the portion of the developer member during an absence of the marking agent at the nip.

16. The method of claim 15 wherein the moving the portion of the squeegee member during the absence of the marking agent comprises moving the squeegee member due to friction between the developer member and the squeegee member.

17. The method of claim 16 wherein the moving comprises driving the portion of the squeegee member at the speed which is slower than the speed of the portion of the developer member.

18. The method of claim 14 wherein the moving the portion of the squeegee member comprises moving to remove excess amounts of the marking agent from the developer member during the providing.

19. A hard imaging device comprising:

a photoconductor;

a developer member configured to move to provide a marking agent upon the photoconductor to develop a latent image upon the photoconductor; and a squeegee member configured to form a nip with the developer member and to move to provide the marking agent upon the developer member, wherein the squeegee member is configured to move at a plurality of different speeds corresponding to a presence and an absence of the marking agent at the nip, and wherein the squeegee member is configured to move at the speed slower than the speed of the developer member during the presence of the marking agent at the nip and to move at the same speed as the developer member during the absence of the marking agent at the nip.

20. The device of claim 19 wherein the developer member and the squeegee member contact one another during the movement of the squeegee member at the plurality of speeds, and wherein the developer member is configured to move at a substantially constant speed during the movement of the squeegee member at the plurality of different speeds.

21. The device of claim 20 wherein the squeegee member is configured to rotate in the same direction during the movement of the squeegee member at the plurality of speeds.

22. The device of claim 19 further comprising a clutch configured to permit the squeegee member to move at the speed of the developer member during the absence of the marking agent and to control the squeegee member to move at the speed slower than the speed of the developer member during the presence of the marking agent.

23. The device of claim 19 wherein the squeegee member is configured to remove excess amounts of the marking agent during the provision of the marking agent upon the developer member.

24. The device of claim 19 wherein the marking agent is a liquid marking agent.

25. The device of claim 24 wherein the liquid marking agent comprises a plurality of ink particles suspended in a liquid carrier, and wherein the ink particles are electrically charged to provide the liquid marking agent upon the developer member.

26. The device of claim 19 wherein the squeegee member is configured such that friction between the squeegee member and the developer member moves the squeegee member at the speed of the developer member during an absence of the marking agent at the nip and the squeegee member is further configured to move at the speed slower than and independent of the speed of the developer member during the presence of the marking agent at the nip.

27. A hard imaging method comprising:

providing marking agent through a nip of a squeegee member and a developer member to provide the marking agent upon the developer member;

after the providing, transferring the marking agent from the developer member to a photoconductor to develop latent images formed upon the photoconductor;

during the providing, moving a portion of the squeegee member which contacts the marking agent at a speed which is slower than a speed of a portion of the developer member which contacts the marking agent; and moving the portion of the squeegee member at the speed of the portion of the developer member during an absence of the marking agent at the nip.

28. The method of claim 27 wherein the moving the portion of the squeegee member during the absence of the marking agent comprises moving the squeegee member due to friction between the developer member and the squeegee member.

29. The method of claim 28 wherein the moving comprises driving the portion of the squeegee member at the speed which is slower than the speed of the portion of the developer member.

30. The method of claim 27 wherein the moving the portion of the squeegee member comprises moving to remove excess amounts of the marking agent from the developer member during the providing.

* * * * *